United States Patent [19]

Arfaei et al.

[11] Patent Number: 4,656,115

[45] Date of Patent: Apr. 7, 1987

[54] EMULSION POLYMERIZATION OF METHACRYLONITRILE IN THE PRESENCE OF A CATIONIC EMULSIFIER AS A VEHICLE FOR VESICULAR PHOTOGRAPHY

[75] Inventors: Ahmad Arfaei, Holyoke; Everett W. Bennett, Longmeadow, both of Mass.

[73] Assignee: James River Graphics, Inc., South Hadley, Mass.

[21] Appl. No.: 800,108

[22] Filed: Nov. 22, 1985

Related U.S. Application Data

[63] Continuation of Ser. No. 474,057, Mar. 10, 1983, abandoned.

[51] Int. Cl.[4] ..... G03C 1/52; G03C 1/60

[52] U.S. Cl. ..... 430/170; 430/152; 430/176; 430/192; 430/197; 430/270; 430/290

[58] Field of Search ..... 430/152, 176, 197, 192, 430/290, 170, 270

[56] References Cited

U.S. PATENT DOCUMENTS

| | | | |
|---|---|---|---|
| 3,161,511 | 12/1964 | Parker et al. | 430/152 |
| 3,457,071 | 7/1969 | Notley et al. | 430/152 |
| 3,622,333 | 11/1971 | Cope | 430/152 |
| 3,622,335 | 11/1971 | Notley | 430/152 |
| 3,622,336 | 11/1971 | Notley | 430/152 |
| 3,661,589 | 5/1972 | Notley | 430/152 |
| 4,215,191 | 7/1980 | Kwok | 430/152 |
| 4,219,616 | 8/1980 | Pope et al. | 430/152 |
| 4,272,603 | 6/1981 | Chenevert et al. | 430/152 |

*Primary Examiner*—Charles L. Bowers, Jr.

*Attorney, Agent, or Firm*—Burns, Doane, Swecker & Mathis

[57] ABSTRACT

An improved vesicular matrix prepared by the emulsion polymerization of methacrylonitrile, either alone or with a small amount of comonomer, in the presence of a cationic emulsifier. The resulting polymer or copolymer can be used alone, or the polymer or copolymer may be blended with a small amount of a highly incompatible polymer or copolymer, to provide an improved vesicular matrix.

3 Claims, No Drawings

EMULSION POLYMERIZATION OF METHACRYLONITRILE IN THE PRESENCE OF A CATIONIC EMULSIFIER AS A VEHICLE FOR VESICULAR PHOTOGRAPHY

This application is a continuation of application Ser. No. 474,057, filed Mar. 10, 1983, now abandoned.

BACKGROUND OF THE INVENTION

1. Field of the Invention

The present invention relates to vesicular photography, and more particularly, to improved vesicular matrices for use in vesicular photography, including novel polymers and copolymers useful therein.

2. Description of the Prior Art

Diazo type photoreproduction is of two different types. Each is based on the light sensitivity of aromatic diazo salts and the fact that such salts undergo two different types of reactions: (1) decomposition, in which nitrogen is lost or evolves as nitrogen gas and some other atom or group attaches to the benzene ring in its stead; and (2) "coupling", wherein the nitrogen of the diazo function is retained and the salts react with certain couplable color-forming components, i.e., a "coupler" or "azo-coupling component", to effect formation of an azo dye species.

The present invention, a vesicular process, is concerned with the former type of reaction. Vesicular images are formed in a photographic film by small bubbles or vesicles of gas which are formed and trapped in the areas of the film exposed to light and which refract light. Vesicular film consists of a colloidal or a resin coating or vehicle on a backing material and a light sensitive agent or sensitizer, such as a diazo compound, dispersed throughout the coating. When the film is exposed to light, the sensitizer releases molecules of a gas. In the case of diazo compounds, the gas is nitrogen. Rather than forming vesicles immediately, the vesicles are formed when the film is heated, presumably because the vehicle is relaxed sufficiently on heating for the gas molecules to form bubbles, and for the bubbles to expand. The formation of the vesicles makes the vehicle opaque to transmission of light in the exposed areas, resulting in the reflection and scattering of light from the vesicles.

Preservation of the image depends upon the vehicle maintaining its rigidity and the vesicles being fixed in place. Although the rigidity of the vehicle is reduced during development to permit gas molecules to diffuse together to form the vesicles and to allow the vesicles to expand, the rigidity is restored by cooling to give permanency to the image after development. For permanency, the vehicle must remain rigid under the heat and moisture conditions to which it will be exposed.

The first vesicular materials employed gelatin as the vehicle. However, such images faded rapidly because of the sensitivity of gelatin to water. Gelatin vehicles absorb moisture from the atmosphere and become soft, allowing the vesicle to collapse, thereby destroying the image.

Numerous patents describe later attempts at developing vesicular matrices. Although numerous such matrices have been developed, only three systems are currently being employed commercially; those being systems based on Saran, polyhydroxyethers of phenols, and poly-alpha-chloroacrylonitrile.

One material which appeared promising but has never been commercialized is polymethacrylonitrile. Despite a suitable softening point and a suitably low diffusion constant for nitrogen, its potential has yet to be realized.

The basic patent concerning polymethacrylonitrile is U.S. Pat. No. 3,161,511 to Parker and Mokler which describes a vehicle manufactured using polymethacrylonitrile as the resin matrix. As stated in that patent, homopolymers are preferable to copolymers because they are easier to manufacture.

The difficulty in the manufacture of copolymers is controlling proportions when there are two or more monomers. Monomers typically do not polymerize at the same rate, i.e. if two monomers are polymerized together, one will enter into the reaction more easily than the other. As the reaction proceeds, the more reactive monomer will be consumed more rapidly, and the relative proportions of the two monomers will change. Since the rate at which the monomers enter into the reaction depends on their relative proportions as well as their inherent activity toward the reaction, their reaction rates change. As the reaction proceeds, the relative proportion of the monomers entering the growing polymer changes, and the polymer produced at the beginning of the reaction has different monomer proportions from the polymer produced later.

To avoid this result, at least in part, monomer is sometimes continuously added during the reaction to maintain constant proportions. Another possibility is to accept variations in the proportions of the monomers in the polymer and to later thoroughly blend the resulting polymers to assure uniform properties throughout each batch. The average properties then meet the needs of the product. However, this may result in variations from batch to batch because of variations in the completeness of the reaction or other conditions.

U.S. Pat. Nos. 3,622,335 and 3,622,336 to Notley are improvements on the Parker and Mokler patent mentioned above. These patents represent attempts to produce copolymers in spite of the problems discussed in the Parker and Mokler patent. The '335 patent employs copolymers of alpha substituted acrylonitrile (which includes methacrylonitrile) and a styrene-type monomer. It is stated therein that the proportion of comonomer must exceed 5 mole percent, and it is not generally desired to exceed 60 mole percent or the desired characteristics of the substituted acrylonitrile will not be obtained. Furthermore, it is stated that any two copolymers produced therein can be blended where they are compatible in a common solvent or mixed solvent, and that the essential polymer can be blended with limited amounts of a non-essential but compatible polymer such as cellulose acetate, cellulose acetate butyrate, polyalphamethylstyrene, polyvinylidene chloride, acrylonitrile copolymer and polymethylmethacrylate.

The '336 patent is similar to the '335 patent except that it describes a copolymer of alpha-chloroacrylonitrile and alpha-methacrylonitrile. The ratio of the monomers was stated to be between 1:4 and 4:1, and a preferred ratio was stated to be 1:2.

U.S. Pat. No. 3,661,589 to Notley describes a different approach. Rather than copolymerization, a vesicular imaging film was formed by mutually dispersing two resin solutions at the threshold of compatibility but having a common or mutual solvent, each of the resin solutions containing a sensitizer which liberates gas on irradiation, coating the resulting dispersion as a thin film, and then drying. The resulting thermoplastic film is stated to be an intimate dispersion of one hydrophobic resin in the other hydrophobic resin with the sensitizer dispersed throughout.

The Notley '589 patent also sets forth the criteria that a hydrophobic resin used in vesicular photography must satisfy, and reiterates that these criteria are very comprehensive and quite critical. These include very low permeability, good rigidity under ambient conditions, a convenient softening temperature at which the polymer is sufficiently fluid to permit vesicles to form but at which the gas permeability is still not excessively high, good solubility, good film forming characteristics, good adhesion to inert substrates and good tolerance for high concentrations of sensitizer.

In the structure described in the Notley '589 patent, hydrophobic resin is encapsulated within a continuous coating of another hydrophobic resin, with the light sensitive gas generating material dispersed throughout the encapsulated and the encapsulating resin. The optimum amount of encapsulated resin is stated to exceed 5% but generally not to exceed 50% of the total resin. The threshold incompatibility described therein is illustrated by mixing two parts of a 20% solution of polystyrene in butanone with one part of a 20% solution of a polyvinylidene chloride/acrylonitrile copolymer in the same solvent. By using polystyrene to Saran in a ratio between 1 to 1 and 1 to 6, the solution is only slightly hazy and good coating quality is said to be achieved from the agitated solution. The threshold incompatibility is seen when the dispersion is allowed to stand since it separates into two layers, one rich in polystyrene and the other in Saran. Preferred encapsulating resins therein are Saran, polyvinyl acetals, copolymers of methacrylonitrile, and chloroacrylonitrile homopolymer and copolymers. The choice of encapsulated resin is based on the diffusion coefficient and the refractive index. Encapsulating/encapsulated resin combinations listed include Saran with polystyrene, ortho/para polychlorostyrene or cellulose acetate; polyvinyl formal with polystyrene or cellulose acetate; polyvinyl formal with polystyrene or polyketone; methacrylonitrile-methylmethacrylate copolymer with Saran or cellulose acetate; and chloroacrylonitrile-styrene copolymer with polystyrene.

While polymethacrylonitrile has a suitable softening point (Tg=120° C.) which should supply good developing and good thermal stability of vesicles, and has a diffusion coefficient for nitrogen which is also very low (approximately $5\times10^{-13}$) which should prevent nitrogen from escaping prior to the development of the film, the technology described by the above patents is not currently being used commercially. Such compositions are slow in comparison to presently marketed films, with the problem appearing to be related to insufficient nucleation, possibly because of high lattice homogeneity of the polymer. For example, in comparison to a similar polymer (poly-alpha-chloroacrylonitrile), a polymethacrylonitrile film is much slower.

Accordingly, a need exists for a vesicular vehicle having the desirable properties of polymethacrylonitrile with a speed comparable to those of commercially available materials.

SUMMARY OF THE INVENTION

One object of the present invention is the provision of a polymer of methacrylonitrile prepared by emulsion polymerization in the presence of a cationic emulsifier.

Another object of the present invention is the provision of a copolymer of methacrylonitrile and less than 5 wt. % of a second monomer, a homopolymer of the second monomer being a polymer which would be incompatible with polymethacrylonitrile, the copolymer being prepared by emulsion polymerization in the presence of a cationic emulsifier.

Yet another object of the invention is the use of the polymer and/or the copolymer as the continuous phase of a light sensitive vesicular material.

Still another object of the invention is the use of the polymer and/or the copolymer blended with less than 5% of a second polymer or copolymer as the continuous phase of a light sensitive vesicular material.

DETAILED DESCRIPTION OF THE INVENTION

As stated above, the present invention comprises in one embodiment, homopolymer and copolymers of methacrylonitrile prepared by emulsion polymerization in the presence of a cationic emulsifier.

The polymethacrylonitrile of the present invention differs from the prior art in that it is produced by emulsion polymerization in the presence of cationic emulsifiers, whereas the polymethacrylonitrile of the prior art was produced by using anionic or nonionic emulsifiers. The use of cationic emulsifiers provides a novel polymethacrylonitrile which is particularly useful as a vesicular matrix. This is in contrast to the generally held belief in the prior art that emulsion polymerization using cationic emulsifiers was not commercially important because it was slower and gave inferior results.

As stated above, an alternative embodiment of the present invention constitutes copolymers of methacrylonitrile with other monomers, the homopolymers of which would be incompatible with polymethacrylonitrile, prepared by emulsion polymerization in the presence of a cationic emulsifier. An example of a suitable comonomer is methacrylamidopropyltrimethyl ammonium chloride, a cationic water soluble monomer. Other suitable comonomers include vinyl acetate, vinyl propionate, and other similar monomers. When used as a comonomer at a weight ratio of 1:20 or less to the methacrylonitrile, copolymers having excellent photospeed are produced.

Although any cationic emulsifier can be used in preparing the polymers and copolymers of the present invention, the following have been found to provide particularly good results: Adogen 432 (trademark of Sherex Chemical Co., Inc. for dialkyl ($C_{12}$–$C_{18}$) dimethyl ammonium chloride); Lodyne S-106 (trademark of Ciba-Geigy for fluoroalkylammonium chloride); Ethoquad C/25 (trademark of Armour Industrial Chemicals Co. for methylpolyoxyethylene ($C_{15}$) cocoammonium chloride); Barquat CME-35 (trademark of Lonza, Inc. for N-cetyl-N-ethyl-morpholinium chloride); and Uniquad CB-50 (trademark of Lonza, Inc. for 1-hydroxyethyl-1-benzyl 2-alkyl imidazolinium chloride).

The amount of emulsifier used can vary over a wide range from about 0.5% to about 10% by weight. The amount of emulsifier used will vary depending upon the ability of the particular emulsifier to stabilize the emulsion.

The use of cationic emulsifiers is preferably combined in the present invention with the use of radial initiators such as azobisisobutyronitrile; 2,2'-azobis(2,4-dimethylpentane nitrile); or 2,2-azobis(2,4-dimethyl-4-methoxypentane nitrile). Other organic and inorganic initiators can also be used in the practice of the present invention including various peroxides and persulfates such as potassium persulfate. Such initiators are used in the present invention at an effective initiating concentration, typically between about 0.3 and about 5% w/w of monomer, preferably about 1–3%, and more preferably about 1–1.5%.

If desired, chain transfer agents can also be employed in the practice of the present invention. Various such agents, such as various mercaptans, are well known to those skilled in the art. A preferred chain transfer agent is dodecyl mercaptan.

While not wishing to be bound by theory, it is believed that the beneficial properties of the polymers and copolymers of the present invention are related to their molecular weight range and distribution which appear to depend somewhat on the amount of initiator employed. The preferred viscosity average molecular weight ($M_v$) for the present invention is between about 10,000 and about 600,000, and more preferably between about 100,000 and about 300,000.

One indication that molecular weight is a relevant factor is the polydispersity of the polymers and copolymers of the present invention. Polydispersity is a measure of the range of different molecular weights in a sample. Polydispersity is typically stated as a ratio of the weight average molecular weight ($M_w$) to the number average molecular weight ($M_n$). $M_n$ is essentially the ratio of the weight of the molecules to the total number of molecules. In contrast, $M_w$ is a weighted average such that the larger the size of a molecule, the greater its contribution to $M_w$. Since polymerizations always results in a range of molecular weights, $M_w$ will always be greater than $M_n$. Thus, the polydispersity ratio will always be greater than one. A typical polydispersity ratio for an emulsion polymerization is about 2.5:1. In contrast, the polydispersity ratio of the polymers of the present invention are high, typically above about 5:1, and preferably between about 6:1 and 11:1. Accordingly, it seems likely that not only the viscosity average molecular weight, but also the molecular weight distribution is important for optimizing the properties of the resulting polymer.

For the polymers and copolymers of the present invention, $M_w$ is preferably between about 50,000 and about 1,500,000, and $M_n$ is preferably between about 10,000 and about 300,000. $M_w$ and $M_n$ are readily determined by methods well known to those skilled in the art, one such method being gel permeation chromatography.

Another alternative embodiment of the present invention is the blending of methacrylonitrile polymer or copolymer produced according to the present invention with other polymers or copolymers. Examples of such polymers are polyvinyl acetate and copolymers of vinyl acetate and vinyl chloride. Such polymers or copolymers are typically used in small amounts, e.g. less than about 5% by weight, preferably less than about 3% by weight.

This embodiment of the present invention should be distinguished from blending of larger amounts (40–90%) of other resins to improve the photospeed of the blend such as that described in U.S. Pat. No. 4,272,603 to Chenevert et al. The system described therein utilizes polymethacrylonitrile at moderate molecular weights. Incorporation of 40 to 90% of an incompatible resin is possible only when the polymethacrylonitrile has a very low molecular weight (less than about 10,000). While that patent does not directly mention the molecular weight of the polymethacrylonitrile used in the Examples, the molecular weight can be derived from the described properties which were improved with blending. Reference should also be made to column 3, lines 55–61 of Chenevert et al wherein it is stated that it is preferable to use lower molecular weight polymers of methacrylonitrile because they are compatible with other polymers over a wider range of proportions, and further that particularly useful polymers have a weight average size of 1440 to 2450.

In preparing films, it is preferred that the composition also contain a nucleating agent. Various nucleating agents are well known in the prior art. Particularly suitable for use in the present invention are anionic, cationic and nonionic fluorocarbon surfactants. Nucleating agents are typically added in small amounts, typically between about 0.02% and about 2.0% by weight, preferably between about 0.1 and about 1.0% by weight.

The vesiculating agent employed in preparing the vesicular film is sensitive to radiation, e.g., light, so that exposure to the radiation causes decomposition and formation of gas vesicles, preferably of nitrogen. Examples of suitable vesiculating agents include the following:

p-diazo-diphenylamine sulfate;
p-diazo-dimethylaniline zinc chloride;
p-diazo-diethylaniline zinc chloride;
p-diazo-ethyl-hydroxyethylaniline . one-half zinc chloride;
p-diazo-methyl hydroxyethylaniline . one-half zinc chloride;
p-diazo-2,5-diethoxy-benzoylaniline . one-half zinc chloride;
p-diazo-ethyl-benzylaniline . one-half zinc chloride;
p-diazo-dimethylaniline borofluoride;
p-diazo-2,5-dibutoxy-benzoylaniline . one-half zinc chloride;
p-diazo-1-morpholino benzene . one-half zinc chloride;
p-diazo-2,5-dimethoxy-1-p-toluyl-mercapto benzene . one-half zinc chloride;
p-diazo-3-ethoxy-diethylaniline . one-half zinc chloride;
p-diazo-2,5-diisopropoxy-1-morpholino benzene sulfosalicylate;
p-diazo-2,5-diisopropoxy-1-morpholino benzene triflate;
p-diazo-2,5-diethoxy-1-morpholino benzene sulfosalicylate;
p-diazo-2,5-diethoxy-1-morpholino benzene triflate;
2,5,4'-triethoxy-diphenyl-4-diazonium oxalate;
p-diazo-diethylaniline . one-half chloride;
p-diazo-2,5-dibutoxy-1-morpholino-benzene chloride . zinc chloride;
p-diazo-2,5-dimethoxy-1-morpholino-benzene chloride . zinc chloride;
p-diazo-2,5-diethoxy-1-morpholino-benzene chloride . one-half zinc chloride;
2-diazo-1-naphthol-5-sulfonic acid;
p-diazo-diethylaniline borofluoride;
p-diazo-2-chloro-diethylaniline . one-half zinc chloride.

Other suitable light-sensitive, nitrogen-forming compounds are the quinone-diazodes, e.g.,

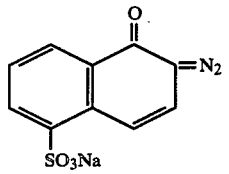

and azide compounds of the type

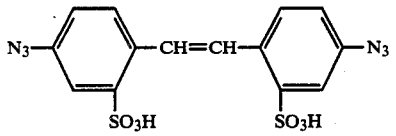

Also the carbazido (carboxylic acid azide) compounds containing a hydroxyl or amino-group in the position ortho to the carbazide group as described in U.S. Pat. No. 3,143,418 would be useful.

It is to be understood that the various physical characteristics of the polymeric materials employed in the present vesicular film system can be varied as desired by the addition of modifiers. Moreover, various materials can be added for the preservation of the sensitizer compound employed, e.g., various acids as taught in the art. Moreover, other materials, such as dyes and other compounds, can be added to improve the photometrics of a particular film without departing from the true scope and spirit of the present invention.

Where a support is employed on which the present vesicular photographic material is overcoated, the support can be any suitable material which is compatible with the medium, e.g. glass, polymeric materials, paper and the like. A polyethylene terephthalate base material is preferred since it has excellent chemical and physical stability under standard processing conditions and it has excellent dimensional stability. As is well known in the art, where a transparent support is employed a vesicular image recorded thereon in the conventional manner produces a corresponding image having the opposite photographic sign. However, the use of an opaque support, e.g. a black support, will produce a photographic image having the same photographic sign.

The vehicle and the sensitizer may be combined by any suitable method. However, it is preferred that they each be dissolved in a solvent and the resultant solutions combined. In this embodiment it is only necessary that the respective solutions be mutually miscible. For the most part, solvents such as alcohols, ketones, nitriles, esters, ethers and halogenated solvents may be used. Particularly useful are methyl, ethyl and isopropyl alcohols, alkyl acetates, acetone, methyl ethyl ketone, dioxane and acetonitrile. However, any inert solvent which meets the above miscibility requirement may be used.

If a diazo compound is used, as is preferred, it is generally dissolved in a small quantity of a polar solvent such as methanol, aqueous methanol, acetonitrile or acetone, and then added dropwise to the stirred resin solution to minimize precipitation of either the salt or the polymer. The preferred amount of the diazo compound is about 4 to 10 percent by weight of the resin used.

When a diazo compound is used as the vesiculating agent, it is preferred, but not necessary, that the solvent in which the diazo compound is dissolved be compatible with the solvent system selected for the resin in order to minimize the possibility of the diazo compound or the resin precipitating out when the two solutions are mixed. It is understood in the art that a uniform dispersion of the vesiculating agent in the vehicle is desired.

After the film is thus prepared, there are at least three different methods of processing it. In one form, the film is exposed to image forming light, e.g., by being placed in contact with a transparency and exposed to light passing through the transparency, then the film is heated to 160°-300° F., for 1/10 to 3 seconds. This will produce an image of the opposite photographic sign from the transparency. Thus, if the transparency is negative, a positive vesicular photograph will result.

A second processing system which can be used is that described in U.S. Pat. No. 2,911,299. In it, the film is exposed to image forming light and gas released by the sensitizer is allowed to diffuse from the vehicle at a temperature too low for development to take place. Then the film is exposed overall to uniform light which actuates non-decomposed sensitizer, and it is heated to cause development at 160°-300° F. for 1/10 to 3 seconds either during or shortly after the second exposure, but before the gas has substantially diffused from the film. This results in image formation in areas not originally struck by light and an image of the same photographic sign as the transparency.

The third processing system is that described in U.S. Pat. No. 3,457,071. In that system, the film is exposed to image forming light of relatively low intensity for at least about 0.5 second and preferably for at least about 2.0 seconds. That is, the light is of low enough intensity that the film does not receive a normal exposure in less than 0.5 second and preferably 2.0 seconds. Then the film receives an overall exposure of light intensity which is sufficient to expose the film in less than 0.2 second and preferably less than 0.01 second. Overexposure or longer exposure can be tolerated, but there must be sufficient light to properly expose the film during the indicated time. This procedure avoids a separate diffusion step as used in the method of U.S. Pat. No. 2,911,299. In some cases, no heating is required to cause development, and the image appears spontaneously. However, in other cases, some heating may be used to advantage, as more fully described in U.S. Pat. No. 3,457,071.

In order to further illustrate the present invention and the advantage thereof, the following specific examples are given, it being understood that they are intended only to be illustrative without limiting the scope of the present invention.

EXAMPLE I

To a one liter flask was added 400 ml of deaerated tap water. To this was added 7.0 g of Adogen 432 (trademark of Sherex Chemical Co., Inc. for dialkyl ($C_{12}$-$C_{18}$) dimethyl ammonium chloride which is 67-69% pure) and 2.0 g of Lodyne S106 (trademark of Ciba-Geigy for fluoroalkyl ammonium chloride) which were dissolved with gentle stirring. Next 100.0 g of distilled methacrylonitrile was added and the contents heated to 69°-70° C. (The distillation was for the removal of any inhibitor.) Stirring was continued while 3.0 g of azobisisobutyronitrile was added. The reaction was allowed to proceed for 8.6 hours after which the contents of the flask were cooled to room temperature and then coagulated from emulsion by the addition of a saturated solution of sodium chloride. The polymer was washed with several aliquots of methanol to ensure that no surfactant remained. The polymer was then dried at 81° C. for 48 hours before measurements were made or incorporation into a film coating. The resulting polymer had a $M_v$ of 42,587, a $M_n$ of 39,200 and a $M_w$ of 292,000, giving the polymer a polydispersity ratio of 7.43:1.

To prepare a film coating, 10.0 g of the polymer was dissolved in 36.0 g of methyl ethyl ketone and 4.0 g of ethylene glycol monomethyl ether. To this was added a second solution containing 2.5 g of 1 wt. % Lodyne S-107 (trademark of Ciba Geigy for fluoroalkyl polyoxyethylene, a nonionic surfactant) in methyl ethyl ketone, and 0.25 g of 10 wt. % polyvinyl acetate in methyl ethyl ketone, 8.0 g of 1 wt. % Orasol Brilliant Blue G-N (trademark of Ciba-Geigy for a blue dyestuff) in methyl ethyl ketone, and 0.8 g of 3,6-diethoxy-4-morpholino-benzene diazonium tetrafluoroborate. The resulting solution was filtered and then coated onto a polyester film having a suitable bonding layer using a No. 22 Mayer Rod. After coating, the film was allowed to dry for one minute at room temperature and for two minutes in an oven maintained at 240° F. The film was processed using a Kodak #2 Photographic Step Tablet as a master. The film was exposed and developed in a commercially available A/M Bruning OP-57 Processor.

The photospeed was compared to commercially available Xidex SX Film developed in the same manner, with the result that the film prepared with the above polymer had a photospeed which was about 47.9% faster than the Xidex SX Film.

EXAMPLE II

Example I was repeated except that 5 g of a 50 wt. % solution of methacrylamidopropyltrimethyl ammonium chloride in water were used with 95 g of methacrylonitrile instead of solely methacrylonitrile monomer, and only 2.4 g of Adogen 432 (trademark of Sherex Chemical Co., Inc. for dialkyl ($C_{12}$–$C_{18}$) dimethyl ammonium chloride) were used. The yield was 77.98% by weight.

A film was prepared and exposed as in Example I except that the polymer was blended with 0.25 g of polyvinylacetate as a 10% solution in methyl ethyl ketone. The resulting film had 129% of the photospeed of Xidex SX Film. Film was also processed in an A/M Bruning OP-57 Processor and found to possess 190.5% of the photospeed of Xidex SX Film.

EXAMPLE III

Example I was repeated except that 3 g of potassium persulfate were used instead of azobisisobutyronitrile, only 1.2 g of Adogen 432 were used, 408 ml of water were used, and the reaction time was 16 hours. The reaction yielded 81% of the polymer having a $M_v$ of 103,672.

When used to prepare a film and processed as in Example I, the resulting film had a speed of 147.9% compared to commercially available Xidex SX Film. When a film was prepared and processed as in Example II, it possessed a speed of 158.5% compared to commercially available Xidex SX Film.

EXAMPLES IV–VIII

To illustrate the dependence of photospeed on viscosity average molecular weight and polydispersity and how the initiator varies same, Example I was repeated with varying amounts of azobisisobutyronitrile. For each example, 100 g of methacrylonitrile, 7 g of Adogen 432 (trademark of Sherex Chemical Co., Inc. for dialkyl ($C_{12}$–$C_{18}$) dimethyl ammonium chloride) and 2 g of Lodyne S-106 (trademark of Ciba-Geigy for fluoroalkylammonium chloride) were used, the latter two ingredients being the cationic emulsifiers used as received as solutions. For each example, the reaction temperature was 69°–70° C. and the speed of the resulting film was compared with Xidex SX film. The results are given in Table I.

TABLE I

| Example | Initiator (grams) | Water (ml) | Reaction Time (Hours) | Yield (%) | $M_v$ | $M_w$ | $M_n$ | $M_w/M_n$ | Photo-Speed |
|---|---|---|---|---|---|---|---|---|---|
| IV | 0.5 | 405 | 10.05 | 93.67 | 544,848 | — | — | — | 89.12 |
| V | 3.0 | 404 | 9.02 | 94.06 | 56,256 | 488,000 | 72,600 | 6.71 | 134.9 |
| VI | 3.0 | 402 | 8.60 | 100.00 | 39,153 | — | — | — | 154.9 |
| VII | 1.0 | 403 | 10.3 | 93.61 | 189,084 | 1,240,000 | 144,000 | 8.63 | 97.7 |
| VIII | 2.0 | 403 | 9.50 | 98.88 | — | 603,000 | 78,700 | 7.65 | 144.5 |

Although the invention has been described in terms of various preferred embodiments, one skilled in the art will appreciate that various modifications, substitutions, omissions, and changes may be made without departing from the spirit thereof. Accordingly, it is intended that the scope of the present invention be limited solely by the scope of the following claims.

What is claimed is:

1. A light sensitive vesicular material comprising a film support and a coating therefor, the continuous phase of said coating comprising:

(a) a copolymer of methacrylonitrile and a photospeed-enhancing amount less than 5 weight percent of a second monomer which is methacrylamidopropyltrimethylammonium chloride, said copolymer being prepared by emulsion polymerization in the presence of a cationic surfactant, or (b) a blend of the polymer of a polymer of methacrylonitrile prepared by emulsion polymerization in the presence of a cationic emulsifier or the copolymer of (a) with a photospeed-enhancing amount less than 5 weight percent of a polymer or copolymer of a vinyl ester which would be incompatible with said polymer or copolymer of methacrylonitrile; and an effective gas-producing amount of a photosensitive solid agent substantially uniformly dispersed within said coating, which agent is capable of decomposing to produce nitrogen gas upon exposure to light.

2. A light sensitive vesicular material comprising a film support and a coating therefor, the continuous phase of said coating comprising:

(a) a copolymer of methacrylonitrile and a photospeed-enhancing amount less than 5 weight percent of a second monomer which is vinyl acetate, said copolymer being prepared by emulsion polymerization in the presence of a cationic surfactant, or (b) a blend of the polymer of a polymer of methacrylonitrile prepared by emulsion polymerization in the presence of a cationic emulsifier or the copolymer of (a) with a photospeed-enhancing amount less than 5 weight percent of a polymer or copolymer of vinyl acetate which would be incompatible with said polymer or copolymer of methacrylonitrile; and an effective gas-producing amount of a photosensitive solid agent substantially uniformly dispersed within said coating, which agent is capable of decomposing to produce nitrogen gas upon exposure to light.

3. A light sensitive vesicular material comprising a film support and a coating therefor, the continuous phase of said coating comprising:

(a) a copolymer of methacrylonitrile and a photospeed-enhancing amount less than 5 weight percent of a second monomer which is a cationic water soluble monomer or a vinyl ester, a homopolymer of the second monomer being a polymer which would be incompatible with polymethacrylonitrile, said copolymer being prepared by emulsion polymerization in the presence of a cationic surfactant, or (b) a blend of the polymer of a polymer of methacrylonitrile prepared by emulsion polymerization in the presence of a cationic emulsifier or the copolymer of (a) with a photospeed-enhancing amount less than 5 weight percent of a copolymer of vinyl acetate and vinyl chloride which would be incompatible with said polymer or copolymer of methacrylonitrile; and an effective gas-producing amount of a photosensitive solid agent substantially uniformly dispersed within said coating, which agent is capable of decomposing to produce nitrogen gas upon exposure to light.

* * * * *